US007896016B2

(12) United States Patent
Shi

(10) Patent No.: US 7,896,016 B2
(45) Date of Patent: Mar. 1, 2011

(54) HUB ASSEMBLY

(75) Inventor: Cheng Fu Shi, Singapore (SG)

(73) Assignee: Golden Season Pte Ltd, Singapore (SG)

( * ) Notice: Subject to any disclaimer, the term of this patent is extended or adjusted under 35 U.S.C. 154(b) by 0 days.

(21) Appl. No.: 12/253,600

(22) Filed: Oct. 17, 2008

(65) Prior Publication Data

US 2010/0095994 A1 Apr. 22, 2010

(51) Int. Cl.
*E04H 15/48* (2006.01)

(52) U.S. Cl. ..... 135/147; 135/135; 135/120.3

(58) Field of Classification Search ..... 135/120.3, 135/120.4, 135, 147; 403/170, 174
See application file for complete search history.

(56) References Cited

U.S. PATENT DOCUMENTS 4,280,521 A * 7/1981 Zeigler ..... 135/120.3
4,437,275 A * 3/1984 Zeigler ..... 52/109
4,627,210 A * 12/1986 Beaulieu ..... 52/646
4,981,387 A * 1/1991 Younjae ..... 403/174
5,069,572 A * 12/1991 Niksic ..... 403/170
5,074,700 A * 12/1991 Swoboda ..... 403/171
5,626,434 A * 5/1997 Cook ..... 403/176
5,797,695 A * 8/1998 Prusmack ..... 403/170
6,378,265 B1 * 4/2002 Konstandt ..... 52/655.2
6,475,117 B1 * 11/2002 Berglund et al. ..... 482/35

* cited by examiner

*Primary Examiner* — David Dunn
*Assistant Examiner* — Noah Chandler Hawk
(74) *Attorney, Agent, or Firm* — Nelson Mullins Riley & Scarborough LLP

(57) ABSTRACT

A hub assembly for use in collapsible structures, said assembly having: a hub body (20) having a centre opening and a plurality of slots extending from the centre opening to a periphery of the hub body (20), a cover (22) disposable in the centre opening, a plurality of flexible members (24) having a plurality of first portions and a plurality of second portions, the first portion being disposed in the slots and a plurality of poles (26) coupled to the second portions of the flexible members (24) by a plurality of hinges (28), wherein the flexible members (24) are operable to move about a plurality of interface points (36) between the first portions and the second portions to rotate each of the poles having a constant rotating centre between a close position and an open position.

19 Claims, 4 Drawing Sheets

HUB ASSEMBLY

FIELD OF INVENTION

The present invention relates to an assembly. More particularly, the present invention relates to a hub assembly for use in collapsible structures.

BACKGROUND OF THE INVENTION

Foldable tents have widely been used by the military for thousands of years. Due to the ease of usage, foldable tents are well-received by military troops. Generally, there are different types of hub used by foldable tents. One type of hub is such that the ends of the supporting poles are laminated and shaped round headedly ("laminated ends"). There is a tiny hole formed within the centre of the laminated ends and hollow-elastic pins ("pins") are inserted thereinto. When the supporting poles are unfolded or retracted, they then use the pins as a centre of rotation. However, it is unavoidable that when the tents are unfolded, the tents will tend to rotate slightly in a direction between the vertical and the axis of the pins. Under such a situation, there is a possibility that the laminated ends might be bent. There is yet another type of hub similar to the one described above with the pins being removed and replaced with a ring with an opening at one end. In the first type of hub, every supporting pole is accompanied by a pin whereas in the second type of hub, several supporting poles are capped with the ring. Assembly of such a structure is troublesome especially due to the limited space provided thereby during maintenance of the tent makes it difficult to perform work thereon. Furthermore, to replace one supporting pole, the tent has to be pulled apart in order to make the necessary replacement. This poses considerable difficulty due to the large sizes of tents.

These two types of hub share a common disadvantage in that both the laminated ends and the main body of the supporting poles are connected using pins. Moreover, the pins of neighbouring supporting poles face each other. This will then affect the retracting of the supporting poles because during retracting, the heads of the pins are in contact with each other thereby hindering with the folding of the tents. In addition, wear-and-tear happens easily when the pins are in frequently contact with each other during retracting of the supporting poles.

Hence, in order to address the foregoing disadvantages of the two types of hubs as described above, the current invention uses a simpler hub assembly for solving the problem.

SUMMARY OF THE INVENTION

There is provided a hub assembly for use in collapsible structures comprising a hub body having a centre opening and a plurality of slots extending from the centre opening to a periphery of the hub body, a cover disposable in the centre opening, a plurality of flexible members having a plurality of first portions and a plurality of second portions, the first portions being disposed in the slots and a plurality of poles coupled to the second portions of the flexible members by a plurality of hinges, wherein the flexible members are operable to move about a plurality of interface points between the first portions and the second portions to rotate each of the poles having a constant rotating centre between a close position and an open position. The cover further includes a screw to fit into the hub body and the centre opening further includes a depression to allow a plurality of swaged clips on the flexible members to sit on it. Each of the flexible members includes two swaged clips, one disposed in the first portion and the other in the second portion. The first portions of the flexible members are positionally fixed relative to the slots when the poles are rotated between the close position and the open position. The first swaged clips of the flexible members are seated in the depression of the hub body and the second swaged clips of the flexible members are nested in the hinges which are coupled to the poles. The flexible members are operable to deform at the interface points. The interface points are located at a plurality of outlets of the hinges, wherein the outlets are curved to maintain a constant length of the flexible members when the poles are rotated so as to ensure rotation of each of the poles about the constant rotating centre. Each hinge includes a cylinder which inserts into a tube and the hinge and tube are held in place by a pin. Each pin on the poles is arranged such that its pin head faces outward to avoid abrasion of the poles when the poles are rotated between the close position and the open position. The poles can be rotated to a maximum of 90 degrees and are in a maximum of 8. In a preferred embodiment, the cover is circular and the hub body is circular or anise in shape and the flexible members are wire ropes or other flexible tapes.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE INVENTION

A hub assembly for use in collapsible structures is provided. In the following description, numerous specific details are set forth in order to provide a thorough understanding of the present invention. It will be understood, however, to one skilled in the art, that the present invention may be practiced without some or all of these specific details.

Figure 1:
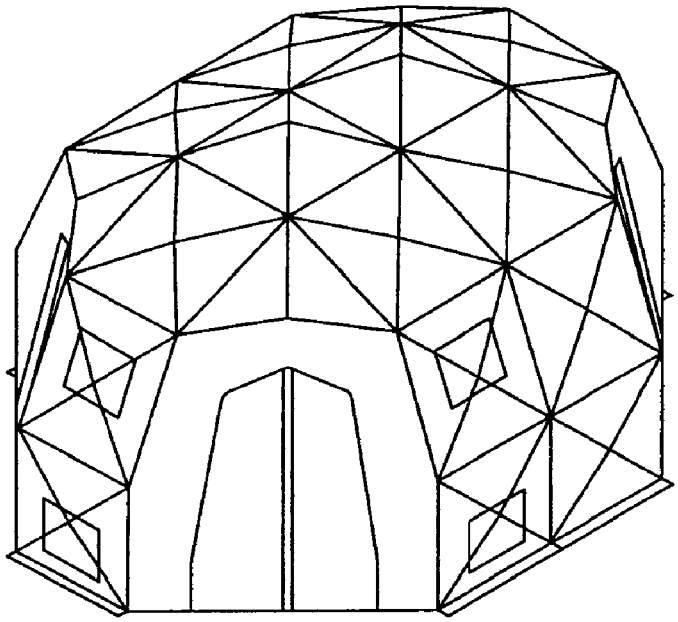
FIG. 1 shows an external view of a tent.
Figure 2:
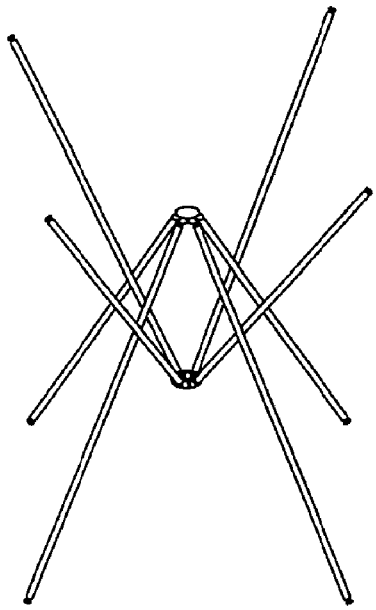
FIG. 2 shows a tent frame structure.

Foldable tents for military applications typically comprise tent frame structures and skins made from nylon fabric. The tent structures are formed by connecting poles to a hub assembly in a particular manner. FIG. 1 shows an external view of a tent. FIG. 2 shows a basic tent frame structure which is assembled using the poles. As shown in FIG. 2, the tent frame structure is formed using a hub assembly connected to several poles. The number of poles connected to a hub is dependant upon its positioning within the tent. One hub is connectable to a maximum of 8 supporting poles.

Figure 3:
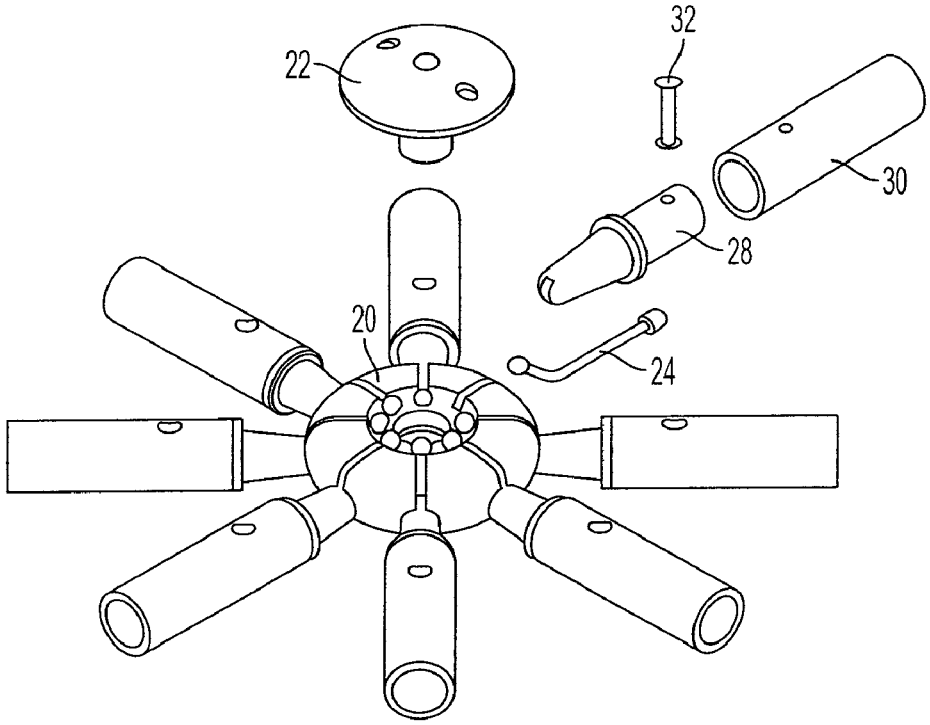
FIG. 3 shows a hub assembly in an open position
Figure 4:
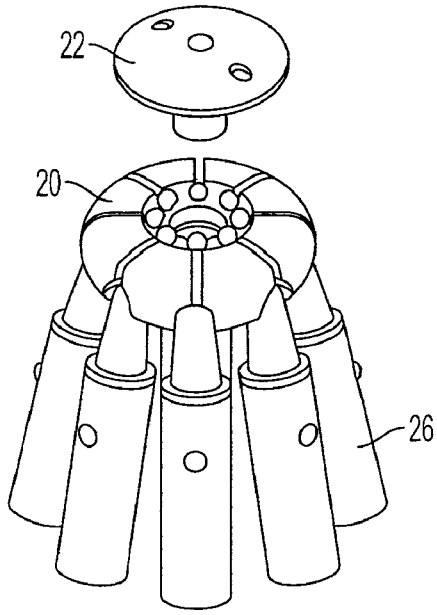
FIG. 4 shows a hub assembly in a close position.
Figure 5:
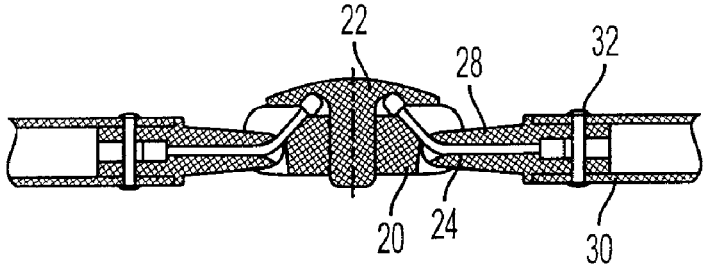
FIG. 5 shows a cross section of a hub assembly in an open position.
Figure 6:
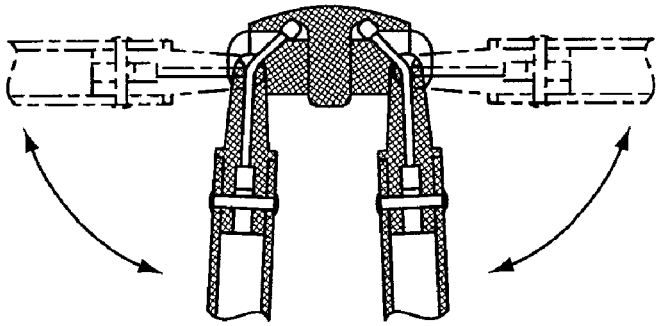
FIG. 6 shows a cross section of a hub assembly moving from a close position to an open position.

FIG. 3 shows a hub assembly in an open position and FIG. 4 shows a hub assembly in a close position. The hub assembly comprises a hub body (20) having a centre opening and a plurality of slots extending from the centre opening to a periphery of the hub body (20). A cover (22) is disposable in the centre opening. There is also a plurality of flexible members (24) having a plurality of first portions and a plurality of second portions, the first portions being disposed in the slots and a plurality of poles (26) coupled to the second portions of the flexible members (24) by a plurality of hinges (28), wherein the flexible members (24) are operable to move about a plurality of interface points (36) between the first portions and the second portions to rotate each of the poles (24) having a constant rotating centre between a close position and an open position. This can be seen in FIGS. 5 and 6. The cover (22) further includes a screw to fit into the hub body (20) and the centre opening further includes a depression to allow a plurality of swaged clips (34) on the flexible members (24) to sit on it. The cover serves to secure a sheet to the hub body (20) and to press the swaged clips on the flexible members in place.

Figure 7:
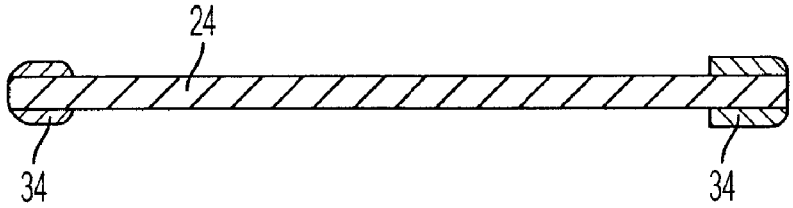
FIG. 7 shows a flexible member with swaged clips
Figure 8:
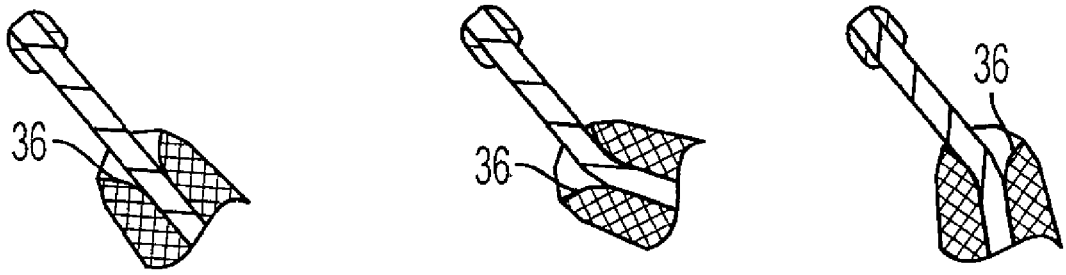
FIG. 8 shows rotating movements of a flexible member around interface points.

FIG. 7 shows a flexible member with swaged clips. Each of the flexible members (24) includes two swaged clips (34), one disposed in the first portion and the other in the second portion. The first portions of the flexible members (24) are positionally fixed relative to the slots when the poles (26) are rotated between the close position and the open position. The first swaged clips of the flexible members are seated in the depression of the hub body (20) and the second swaged clips of the flexible members are nested in the hinges (28) which are coupled to the poles (26). Such an arrangement allows the swaged clips to hold the hub body (20) and the respective hinges tightly. Further, the flexible members (24) are operable to deform at the interface points (36). As seen from FIG. 8, these points are located at a plurality of outlets of the hinges (28), wherein the outlets are curved to maintain a constant length of the flexible members (24) when the poles are rotated so as to ensure rotation of each of the poles about the constant rotating centre. Therefore, whether the poles are rotated about an axis, rotated upwards to the open position or rotated downwards to the close position, the length of the flexible members remains unchanged. Consequently, the tightness holding the hub body and the hinges also remains constant.

Figure 9:
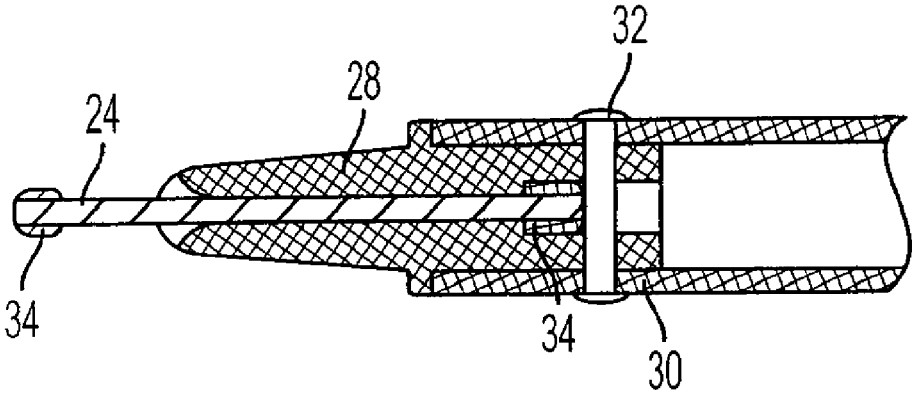
FIG. 9 shows a cross section of a pole.

As shown in FIG. 9, each hinge (28) includes a cylinder which fits into a tube (30) and the hinge and the tube are held in place by a pin (32). Each pin (32) on the poles (26) is arranged such that its pin head faces outward to avoid abrasion of the poles when the poles (26) are rotated between the close position and the open position. The arrangement of the pins (32) ensures that the poles (26) will not be in contact with each other during the close and open position. Further, the poles (26) can be rotated to a maximum of 90 degrees and there are a maximum of 8 poles. These poles (26) are simultaneously opened or closed in order to either unfold or fold the tent for usage and storage respectively. In a preferred embodiment, the cover (22) is circular and the hub body (20) is circular or anise in shape and the flexible members are wire ropes or other flexible tapes.

The construction of the hub assembly is simple and takes lesser time to fix up. During wear-and-tear, the parts, i.e. poles or flexible members may also be removed and replaced easily.

Other embodiments of the invention will be apparent to those skilled in the art from consideration of the specification and practice of the invention. Furthermore, certain terminology has been used for the purposes of descriptive clarity, and not to limit the present invention. The embodiments and preferred features described above should be considered exemplary, with the invention being defined by the appended claims.

What is claimed is:

1. A hub assembly for use in collapsible structures, said assembly comprising:

a hub body (20) having a centre opening and a plurality of slots extending from the centre opening to a periphery of the hub body;

a cover (22) disposable in the centre opening;

a plurality of flexible members (24) that are deformable, each flexible member having a first portion and second portion and further having a first contact surface and a second contact surface, the first portion being disposed in the a slot; and a plurality of poles (26) coupled to the second portion of the flexible members (24) by a plurality of hinges (28), wherein the flexible members (24) are deformable to move about a plurality of interface points (36) between a first position contacting the first contact surface and a second position contacting the second contact surface to rotate each of the poles (26) having a constant rotating centre between a close position and an open position.

2. A wire hub assembly according to claim 1, wherein the cover (22) further includes a screw to fit into the hub body (20).

3. A hub assembly according to claim 1, wherein the centre opening further includes a depression to allow a plurality of swaged clips (34) on the flexible members (24) to sit on it.

4. A hub assembly according to claim 1, wherein each of the flexible members (24) includes two swaged clips (34), one disposed at the first portion and the other at the second portion.

5. A hub assembly according to claim 4, wherein the first swaged clips of the flexible members are seated in the depression of the hub body and the second swaged clips of the flexible members (24) are nested in the hinges (28) which are coupled to the poles (26).

6. A hub assembly according to claim 1, wherein the first portions of the flexible members (24) are positionally fixed relative to the slots when the poles (26) are rotated between the close position and the open position.

7. A hub assembly according to claim 1, wherein the flexible members (24) are operable to deform at the interface points (36).

8. A hub assembly according to claim 7, wherein the interface points (36) are located at a plurality of outlets of the hinges (28).

9. A hub assembly according to claim 8, wherein the outlets are curved to maintain a constant length of the flexible members (24) when the poles (26) are rotated so as to ensure rotation of each of the poles about the constant rotating centre.

10. A hub assembly according to claim 1, wherein the flexible members (24) are wire ropes or other flexible tapes.

11. A hub assembly according to claim 1, wherein each hinge (28) includes a cylinder which inserts into a tube (30) and the hinge and tube are held in place by a pin (32).

12. A hub assembly according to claim 11, where each pin (32) on the poles (26) is arranged such that its pin head faces outward to avoid abrasion of the poles (26) when the poles (26) are rotated between the close position and the open position.

13. A hub assembly according to claim 12, wherein the poles (26) are in a maximum of 8.

14. A hub assembly according to claim 1, wherein the poles (26) can be rotated to a maximum of 90 degrees.

15. A hub assembly according to claim 1, wherein the cover (22) is circular in shape and the hub body (20) is circular or anise in shape.

16. A collapsible structure comprising a plurality of hub assemblies according to claim 1 wherein the hub assemblies are interconnected.

17. The collapsible structure according to claim 16 wherein the hub assemblies are interconnected by poles (26).

18. The collapsible structure of claim 17 further comprising a skin.

19. A collapsible tent comprising the collapsible structure of claim 17 and a skin.

* * * * *